US007672603B2

(12) United States Patent
Yamamoto et al.

(10) Patent No.: US 7,672,603 B2
(45) Date of Patent: Mar. 2, 2010

(54) IMAGE FORMATION CONTROL BASED ON PRINTING RATE

(75) Inventors: Takeo Yamamoto, Abiko (JP); Shigeo Hata, Toride (JP); Naohisa Nagata, Moriya (JP); Mitsuhiro Ota, Toride (JP); Daisaku Kamiya, Abiko (JP)

(73) Assignee: Canon Kabushiki Kaisha (JP)

( * ) Notice: Subject to any disclaimer, the term of this patent is extended or adjusted under 35 U.S.C. 154(b) by 258 days.

(21) Appl. No.: 11/859,263

(22) Filed: Sep. 21, 2007

(65) Prior Publication Data

US 2008/0075485 A1 Mar. 27, 2008

(30) Foreign Application Priority Data

Sep. 22, 2006 (JP) ..... 2006-257521

(51) Int. Cl.
*G03G 15/00* (2006.01)

(52) U.S. Cl. ..... 399/49

(58) Field of Classification Search ..... 399/39, 399/49, 53, 58, 60
See application file for complete search history.

(56) References Cited

U.S. PATENT DOCUMENTS 6,181,888 B1 * 1/2001 Scheuer et al. ..... 399/49
6,434,348 B1 * 8/2002 Tomizawa ..... 399/49 X
6,633,734 B2 * 10/2003 Maebashi et al. ..... 399/49
6,768,878 B2 * 7/2004 Komatsu et al. ..... 399/49
2005/0276620 A1 * 12/2005 Omata ..... 399/49

FOREIGN PATENT DOCUMENTS

JP 9-319270 A 12/1997
JP 9-326926 A 12/1997
JP 10-186769 A 7/1998

* cited by examiner

*Primary Examiner*—Sandra L Brase
(74) *Attorney, Agent, or Firm*—Rossi, Kimms & McDowell LLP

(57) ABSTRACT

An image forming apparatus that can realize an image having adequate image quality, density and color, without provoking excessive consumption of a developer and reduction in productivity. Image formation is performed by forming a latent image on an image carrier based on image information, then developing and transferring the latent image. An image for adjustment on a portion is formed other than a portion on which the latent image is formed on the image carrier. The density of the image for adjustment is detected. Image density is adjusted based on the density of the detected image for adjustment. Image formation control is executed whereby density is adjusted when an image is formed. A printing rate that indicates the percentage of the image formation to a sheet used for image formation is calculated. When the printing rate is determined to be within a set range, the image formation control is executed at a set frequency. On the other hand, when the printing rate is determined to be outside the set range, the set frequency is changed and the image formation control is executed.

7 Claims, 14 Drawing Sheets

IMAGE FORMATION CONTROL BASED ON PRINTING RATE

BACKGROUND OF THE INVENTION

1. Field of the Invention

The present invention relates to an image forming apparatus and an image formation control method thereof, which are applied to improve image quality when electrophotographic image formation is performed.

2. Description of the Related Art

Conventionally, an image forming apparatus comprises an image adjustment function that all the adjustment process is operated in the device in order to suppress changes in color concomitantly to a change in environment or a change over time, and changes in color after replacement of each part due to consumption and various types of maintenance work (see e.g. Japanese Laid-Open Patent Publication (Kokai) No. H09-319270 and Japanese Laid-Open Patent Publication (Kokai) No. H09-326926).

The above related art has executed the following control. The control includes maximum density (Dmax) control, tone (half tone) control, detection of life duration of various parts, and toner density control in a developing unit. The control is executed when a certain condition is reached based on counter information indicating the printing (copying) number of sheets, power source information indicating the state of a power source, and environmental sensor (temperature-humidity sensor) information indicating the state of environment; thus allowing the image to be stabilized.

The above tone control is control by which image density is detected by a sensor placed on a photoconductive drum or a transfer belt, or on the downstream side of a fixing device, and the detected image density is compared with target image density and corrected. The tone control can suppress changes in color occurring due to a change in environment or a change over time, and has applications using an image forming apparatus as a proofer (color proofreader).

In addition, there is an increase in applications using the image forming apparatus as a convenience printer, a so-called print on demand (POD) machine, concomitantly to an increase in speed. In particular, an electrophotographic image forming apparatus can instantly form images without proofing operation, in recent years drawing attention as a printer suitable for individual image formation according to a client's demand, a so-called variable data printing.

Meanwhile, a technique has been proposed where the frequency of image density adjustment is adjusted (controlled) by predicting the state of the image forming apparatus (see e.g. Japanese Laid-Open Patent Publication (Kokai) No. H10-186769).

However, it has been known that when an electrophotographic image forming apparatus is used for image formation, the fluctuation level of the image density is different depending on the application and frequency in use of the image forming apparatus, in particular, depending on difference (level) in printing rates. This is caused by variations in the amount of supply of a developer accompanying difference in the consumption of developers depending on difference in printing rates and variations in the rising property of the amount of electrical charge of the supplied developer.

In particular, when individual image formation is performed in response to the demand of a client, such as in the above variable data printing, since the printing rate is extremely different from one copy of a print product to another, a problem arises that a common image color does not match at each copy of the print product, or the image color does not match for a predetermined portion. Therefore, there is a problem that a good image with matching color cannot be provided to each client, and the purpose of the variable data printing cannot be achieved sufficiently.

In order to solve the above problem, an approach of more frequently adjusting image density is considered. However, when the image density is frequently adjusted, problems arise that a developer for adjusting the image density is excessively consumed, and productivity is reduced. In addition, the excessively consuming the developer causes the problem to worsen when a print product in which a shift in color does not pose much of a problem is formed, for example, even when an image is formed for flyers for simple distribution, excessive adjustment of image density is executed.

Meanwhile, when a technique of adjusting (controlling) the frequency of image density adjustment described in the above Japanese Laid-Open Patent Publication (Kokai) No. H10-186769 is applied to an image forming apparatus with a high copy number of image formation per unit time such as a convenience printer (POD machine), which causes the following problem. Even if image density is adjusted after the image density changed, a predetermined time is needed until the image density is adjusted, that is to say, until feedback is applied. As a result, there is a problem that it is impossible to stabilize the color of the image in a predetermined range.

SUMMARY OF THE INVENTION

The present invention provides an image forming apparatus and an image formation control method thereof that can realize an image having adequate image quality, density and color, without provoking excessive consumption of a developer and reduction in productivity.

In a first aspect of the present invention, there is provided an image forming apparatus comprising an image forming unit adapted to perform image formation by forming a latent image on an image carrier based on image information, then developing and transferring the latent image, another image forming unit adapted to form an image for adjustment on a portion other than a portion on which the latent image is formed on the image carrier by the image forming unit, a detecting unit adapted to detect the density of the image for adjustment, an adjustment unit adapted to adjust image density based on the density of the image for adjustment detected by the detecting unit, an image formation control executing unit adapted to execute image formation control whereby density is adjusted by the adjustment unit when an image is formed by the image forming unit, and a control unit adapted to calculate a printing rate that indicates the percentage of the image formation to a sheet used for image formation, and, when the printing rate is determined to be within a set range, execute the image formation control at a set frequency, on the other hand, when the printing rate is determined to be outside the set range, change the set frequency and execute the image formation control.

According to the present invention, an image having the adequate image quality, density and color can be realized according to the purpose of a print product, without provoking excessive consumption of a developer and reduction in productivity, even in an image forming apparatus having large fluctuations in a printing rate.

The control unit can execute the image formation control before and after the image formation of the determined image information when the printing rate is determined to be outside the set range.

The printing rate can be calculated with respect to each image color component for one page comprised of multiple colors, the image forming unit can form the latent image for the each color of the image on the image carrier, the another image forming unit can form the image for adjustment between the latent images for the each color formed on the image carrier, and the control unit can calculate the printing rate for the each color of the image, and, when at least one of the printing rates is determined to be outside the set range, can execute the image formation control before and after the image formation of the determined image information.

The image forming apparatus can further comprise a keeping step of keeping the history of the printing rate for each page, wherein the control unit can determine the frequency of execution of the image formation control based on the history when image formation of a plurality of pages is performed successively.

The control unit can set the frequency of execution of image formation control that is executed between the pages determined to be successively outside the set range as an integrated value of the determined frequency when the printing rate at each page of the history is successively outside the set range.

The image forming apparatus can further comprise a state selection unit adapted to select the image formation state of an image product, wherein the control unit can change the frequency of execution of the image formation control according to the image formation state selected by the state selection unit.

The image formation state can be selected from a group including normal image quality, cost priority image quality, and high-end image quality.

The image forming apparatus can further comprise an image formation mode selection unit adapted to select an image formation mode of an image product, wherein the control unit can change the frequency of execution of the image formation control according to the image formation mode selected by the image formation mode selection unit.

The image formation mode can be selected from a group including a text mode, a text/photographic mode, and a photographic mode.

The adjustment unit can control an image formation condition including a lookup table for converting the image information into an image signal suitable for image formation, the charge amount, the exposure amount, the developing bias and the supply amount of a developer.

In a second aspect of the present invention, there is provided a control method of an image forming apparatus comprising an image forming step of performing image formation by forming a latent image on an image carrier based on image information, then developing and transferring the latent image, another image forming step of forming an image for adjustment on a portion other than a portion on which the latent image is formed on the image carrier in the image forming step, a detecting step of detecting the density of the image for adjustment, an adjustment step of adjusting image density based on the density of the image for adjustment detected in the detecting step, an image formation control executing step of executing image formation control whereby density is adjusted in the adjustment step when an image is formed in the image forming step, and a control step of calculating a printing rate indicating the percentage of the image formation to a sheet used for image formation, and, when the printing rate is determined to be within a set range, executing the image formation control at a set frequency, on the other hand, when the printing rate is determined to be outside the set range, changing the set frequency and executing the image formation control.

Further features of the present invention will become apparent from the following description of exemplary embodiments with reference to the attached drawings.

DESCRIPTION OF THE EMBODIMENTS

The present invention will now be described in detail with reference to the drawings showing preferred embodiments thereof. It should be noted that the relative arrangement of the components, the numerical equations and numerical values set forth in these embodiments do not limit the scope of the present invention unless it is specifically stated otherwise.

Embodiments of the present invention will be described below with reference to the drawings.

First Embodiment

Figure 1:
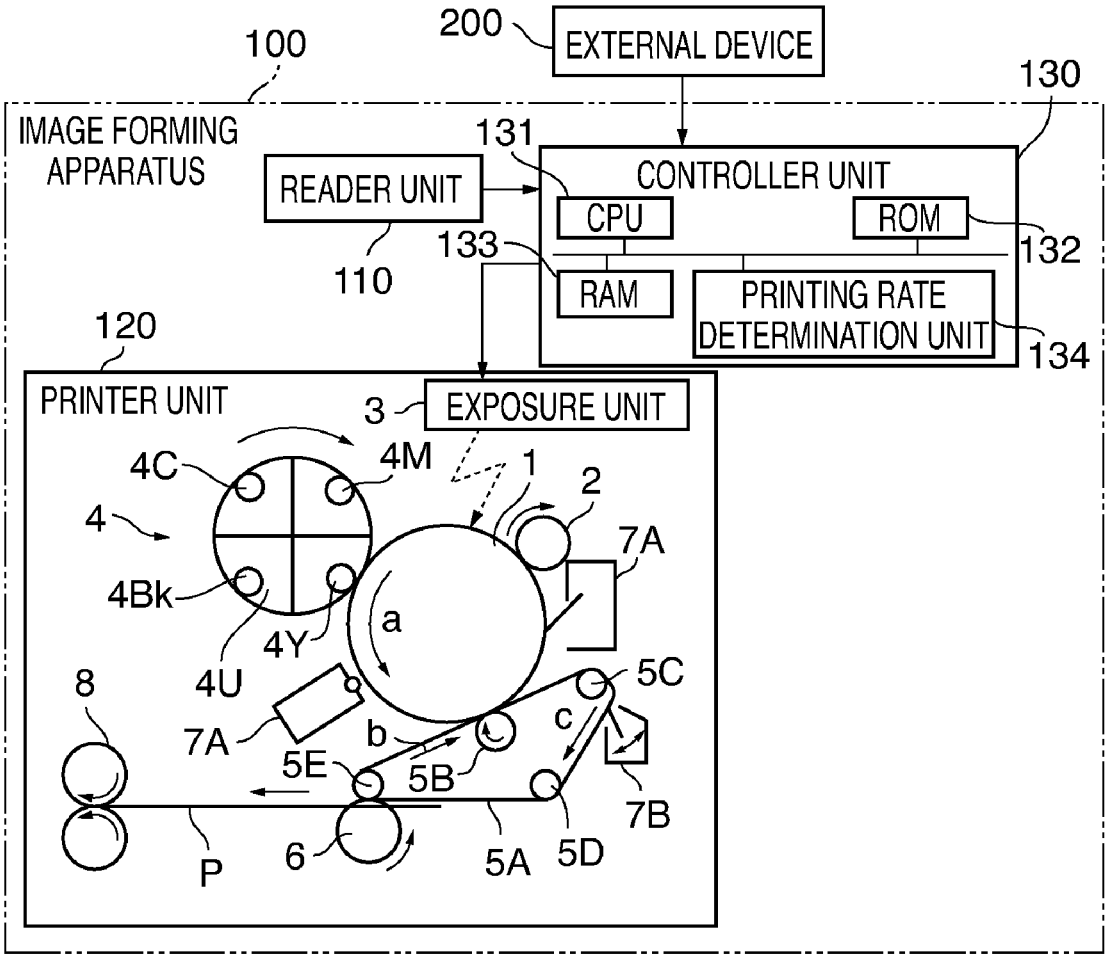
FIG. 1 is a diagram showing the configuration of essential parts of an image forming apparatus according to a first embodiment of the present invention.

FIG. 1 is a diagram showing the configuration of the essential parts of an image forming apparatus according to a first embodiment of the present invention.

In FIG. 1, an image forming apparatus 100 according to the present embodiment is constituted as a full-color electrophotographic image forming apparatus comprising a reader unit 110, a printer unit 120, a controller unit 130 and an operation unit (not shown). In addition, the image forming apparatus 100 can receive image information sent from an external device 200 such as a PC. Note that, in the present embodiment, the image forming apparatus 100 is a copying machine (complex machine) that reads and forms an image, but without limiting thereto, the device may be a printer that performs only image formation.

The reader unit 110 reads an image from an original document and outputs image information to the controller unit 130. The printer unit 120 comprises a photoconductive drum 1, a charger roller 2, an exposure unit 3, a developing unit 4, an intermediate transfer belt 5A, a fixing device 8, and a density detecting unit 10 in FIG. 2 described later, and generates print products by performing image formation on a sheet based on the control of the controller unit 130. The operation unit is used when a user performs various settings (selection of image quality and image formation mode described later in second and third embodiments).

The controller unit 130 comprises a CPU 131 for controlling each unit, a ROM 132 in which programs and fixed data are stored, a RAM 133 used for work space of the CPU 131 and temporary storage area of data, and a printing rate determination unit 134. The controller unit 130 processes an image signal entered from the reader unit 110 and the external device 200 into a signal suitable for the printer unit 120. In addition, in the controller unit 130, the CPU 131 performs processes shown in each flowchart described later based on the programs stored in the ROM 132.

The printing rate determination unit 134 has a video counter (not shown) for counting image information corresponding to image color components (each of yellow (Y), magenta (M), cyan (C) and black (Bk) colors) for one page, and counts the integrated value of formed image information and determines (calculates) the printing rate. The printing rate determination unit 134 determines (calculates) the printing rate of each image color component (yellow (Y), magenta (M), cyan (C) and black (Bk)) for one page before image formation. The printing rate is the percentage of image formation to the whole sheet used for image formation. Note that the CPU 131 may have the function of the printing rate determination unit 134.

The image formation in the printer unit 120 is performed following image formation steps based on an electrostatic charge step, a latent image formation step, a development step, a transfer step and a fixing step. After the surface of the photoconductive drum 1, which is an image carrier, is charged by the charger roller 2, and an electrostatic latent image is formed thereon by the irradiation of a laser beam, the electrostatic latent image is developed as a toner image by the developer of the developing unit 4 (the electrostatic charge step, the latent image formation step and the development step). The toner image on the photoconductive drum 1 is transferred to a sheet P through the intermediate transfer belt 5A (the transfer step), and fixed by the fixing device 8 (the fixing step).

In the electrostatic charge step, the charger roller 2 uniformly charges the surface of the photoconductive drum 1 to a predetermined potential by applying charge bias voltage. In the latent image formation step (exposure step), the exposure unit (laser writing unit) 3 sequentially radiates a laser beam to the photoconductive drum 1 according to the image information of each of the yellow, magenta, cyan and black colors processed by the controller unit 130 based on the image information from the reader unit 110. The photoconductive drum 1, which was uniformly charged to predetermined voltage in the electrostatic charge step, is radiated with the laser beam in the latent image formation step, then the surface potential of the portion on the photoconductive drum 1 on which the laser is radiated is changed, and the portion becomes an electrostatic latent image.

The developing unit 4 has a yellow developing unit 4Y, a magenta developing unit 4M, a cyan developing unit 4C and a black developing unit 4Bk arranged in a rotary development unit 4U, each containing a developer in which a toner and a carrier are mixed at a determined ratio for associated color for developing. The yellow developing unit 4Y, the magenta developing unit 4M, the cyan developing unit 4C and the black developing unit 4Bk contain a yellow developer, a magenta developer, a cyan developer and a black developer, respectively. In the development step, each of the developing units 4Y to 4Bk sequentially transfers (moves) the developer to the electrostatic latent image formed on the photoconductive drum 1 to form a toner image.

In the transfer step, when the toner image is formed on the photoconductive drum 1 by one of the developing units 4Y to 4Bk in the development step, the visualized toner image is transferred to the intermediate transfer belt 5A by the transfer roller 5B. Subsequently, the toner image formed on the photoconductive drum 1 by another among the developing units 4Y to 4Bk is superimposed on the previous toner image, and transferred by the transfer roller 5B to the intermediate transfer belt 5A. Accordingly, the toner images of the four colors, each of which is formed by each of the developing units 4Y to 4Bk, are superimposed on the intermediate transfer belt 5A. In addition, in the transfer step, the toner images transferred to the intermediate transfer belt 5A from the photoconductive drum 1 are transferred to the sheet P by the transfer roller 6.

In the fixing step, non-fixed toner image formed on the sheet P is fixed by the fixing device 8 comprised of a fixing roller and a pressure roller. In a case of single-sided printing, the sheet P to which the toner image is fixed is ejected outside the device by an ejection roller. In a case of double-sided printing, the sheet P to which the toner image is fixed is ejected outside the device by the ejection roller after the toner image is transferred and fixed to the reverse side in the above described step.

In the above image formation step, the toner or the like remaining on the photoconductive drum 1 is cleaned by a cleaner 7A, and the toner or the like remaining on the intermediate transfer belt 5A is cleaned by a cleaner 7B. The subsequent image formation is performed after the toner image previously formed on the photoconductive drum 1 and the intermediate transfer belt 5A is eliminated.

Next, the photoconductive drum 1, the charger roller 2, the exposure unit 3, the developing unit 4, the intermediate transfer belt 5A, the transfer roller 5B, and the transfer roller 6, which constitute the printer unit 120 of the image forming apparatus 100, will be described in more detail.

As the photoconductive drum 1 according to the present embodiment, an OPC photoreceptor having a diameter of 80 mm and a length of 320 mm is used. The OPC photoreceptor is a negative charging electric polar photoreceptor (negative photoreceptor) comprised of a photosensitive layer (photoconductive layer) formed on a conductive drum substrate made of aluminum or the like and its outer surface. The photoconductive drum 1 is rotationally driven by a process speed (peripheral velocity) of 150 mm/sec in a direction of the arrow "a" shown in FIG. 1.

The charger roller 2 has a composite layer structure comprised of a central core metal, an elastic conductive layer concentrically and integrally formed on its periphery in a roller shape, and a resistive layer further formed on the outer surface thereof. The elastic conductive layer is, for example, $10^4$ Ωcm or less of a single or composite layer of a conductive rubber or the like. The resistive layer is about $10^7$ to $10^{11}$ Ωcm and 100 μm thickness or less of a single or composite layer of a conductive rubber or the like. The charger roller 2 is supported by a bearing (not shown) with both ends of the core metal so as to rotate freely, and is pressure welded with predetermined pressing force on the photoconductive drum 1 by a pressure device (not shown). In the present embodiment, the charger roller 2 rotates concomitantly to and driven by the rotary drive of the photoconductive drum 1.

In addition, predetermined charge bias voltage is applied to the core metal of the charger roller 2 from a power source (not shown), therefore the outer surface of the photoconductive drum 1 is charged uniformly. In the present embodiment, an AC charging method, which excels in convergence of potentials, is used as an application method of charge bias voltage. An AC charging method superimposes DC bias on AC bias, and when the AC bias is equal to or greater than a predetermined electric field, the potential of the photoconductive drum 1 converges to be almost equal to the DC bias. In the present embodiment, as AC bias in the charge bias during image formation, a sine wave having a frequency of 1200 Hz and a Vpp of 1.7 kV is used, and −620 V is applied as DC bias. This allows the surface potential of the photoconductive drum 1 to be −600 V.

The image information to expose the desired laser beam for each of the yellow, magenta, cyan and black colors to the photoconductive drum 1 from the exposure unit 3 is obtained with the following method. The image information is constituted by an image signal resulting from processing suitable to the printer unit 120 by the controller unit 130, on the image information for the original document read by the reader unit 110, or the image information sent by the external device 200 to the image forming apparatus 100. The image information is transferred from the controller unit 130 to the exposure unit 3.

In the present embodiment, the laser exposure amount exposed to the photoconductive drum 1 from the exposure unit 3 is adjusted so that the surface potential of a solid image formation area (bright potential area) is to be −180 V for each color on the photoconductive drum 1. That is to say, the surface potential of the latent image portion on the photoconductive drum 1 is reduced by the laser beam relative to −600 V of surface potential (size in a negative direction) of the charged surface by the charger roller 2. A portion on which the surface potential on the photoconductive drum 1 is changed becomes a latent image.

Note that, in the present embodiment, a case where a latent image is formed by changing the surface potential of the photoconductive drum 1 by the electrophotographic method using the exposure unit 3 is taken as an example, however, the present invention is not limited thereto. For example, the latent image can be formed by changing the surface potential of the photoconductive drum 1 by an electrostatic recording process.

Each of the yellow developing unit 4Y, the magenta developing unit 4M, a cyan developing unit 4C and the black developing unit 4Bk performs development by a development method using a two-component developer. The two-component developer is a developer in which a toner and a magnetic particle (carrier) are mixed at a predetermined ratio. In each of the developing units 4Y to 4Bk, a development sleeve, which is a developer carrier containing a magnet, restrains the developers, and the developing bias moves the developer to the photoconductive drum 1. Thus, the desired density image is formed. In addition, all of toners are negative toners having negative polarity.

In the present embodiment, as AC bias in developing bias during image formation, a rectangular wave having a frequency of 2400 Hz and a Vpp of 2.0 kV is used, and −450 V is superimposed as DC bias. In addition, the ratio of the developer in each of developing units 4Y to 4Bk is set so that the maximum density of each color may be 1.5 (optical density). In the present embodiment, the ratio of the toner and the carrier (T/C ratio) for each color is set to 10%.

The intermediate transfer belt 5A, the transfer roller 5B and the transfer roller 6 constitute a transfer system according to the present embodiment. The intermediate transfer belt 5A is an intermediate transfer member wound around the transfer roller 5B and driving rollers 5C to 5E so as to flat over a given region including the transfer portion of the photoconductive drum 1. The intermediate transfer belt 5A is synchronized with the rotation of the photoconductive drum 1 by the driving rollers 5C to 5E driven by a driving mechanism (not shown) and rotationally driven at the same speed as the rotational speed (peripheral velocity) of the photoconductive drum 1 in the direction of arrows "b" and "c". Accordingly, the toner images formed on the photoconductive drum 1 by each of developing units 4Y to 4Bk are transferred so as to be sequentially superimposed on the intermediate transfer belt 5A.

The perimeter of the intermediate transfer belt 5A is set to be the integral multiple (e.g. two to five times) of the perimeter of the photoconductive drum 1. In the present embodiment, the setting is two times the perimeter of the photoconductive drum 1, which is $2\times80\times\pi$ (mm). In addition, the intermediate transfer belt 5A is formed from a single layer conductive rubber, and set to a thickness of 100 μm and a resistance of $1\times10^9$Ω.

The transfer roller 5B is a primary transfer device for transferring the toner image in each color formed on the photoconductive drum 1 to the intermediate transfer belt 5A, and provided on the reverse side (transfer unit) of the opposite surface to the photoconductive drum 1 on the intermediate transfer belt 5A. The transfer roller 5B is comprised of a central core metal, and an elastic layer with a middle resistance concentrically and integrally formed on the periphery in a roller shape. In the present embodiment, the transfer roller 5B is a conductive rubber roller having a resistance of $5\times10^6$Ω and a diameter of 16 mm.

Predetermined bias (plus-side bias in the present embodiment) voltage having polarity opposite to the toner image, which is primary transfer bias voltage, from the power source (not shown) is applied to the core metal portion (not shown) of the transfer roller 5B. Accordingly, the toner image in each color formed on the photoconductive drum 1 is transferred to the intermediate transfer belt 5A by the transfer roller 5B.

The transfer roller 6 is a secondary transfer device for transferring the toner image in each color transferred to and carried on the intermediate transfer belt 5A to the sheet P, and is provided on a portion opposite to the driving roller 5E. The transfer roller 6 is comprised of a central core metal (not shown), and an elastic layer with a middle resistance concentrically and integrally formed on the periphery in a roller shape. In the present embodiment, the transfer roller 6 is a conductive rubber roller having a resistance of $5\times10^8$Ω and a diameter of 16 mm.

Predetermined secondary transfer bias (plus-side bias in the present embodiment) voltage having polarity opposite to the toner image from the power source (not shown) is applied to the core metal portion (not shown) of the transfer roller 6. Accordingly, the toner image in each color formed on the intermediate transfer belt 5A is transferred to the sheet P by the transfer roller 6. The sheet P to which the toner image is transferred is carried to the fixing device 8 and the toner image is fixed to the sheet P by the fixing device 8; then a sequence of image formation is completed.

The image forming apparatus 100 performs electrophotographic image formation following the image formation steps described above in the printer unit 120. In this case, in the electrophotographic image formation, the property tends to change depending on the surrounding environment of the image forming apparatus 100 and its usage. Under a fixed image formation condition, it is difficult to form an image whose color is always stabilized on a sheet.

Thus, in the present embodiment, the density of the toner image formed on the photoconductive drum 1 is detected by the density detecting unit 10, and, based on detected information, the image formation condition for performing the above image formation step is controlled (image formation control) so as to obtain the desired tone property. Here, the image formation condition includes a lookup table (LUT) for converting image information of each color into a image signal suitable for the printer unit 120, the charge amount of the photoconductive drum 1 by the charger roller 2, the exposure amount of the exposure unit 3, the developing bias of the developing unit 4 and the supply amount of developer.

Next, the configuration of the density detecting unit 10 used for image formation control in the image forming apparatus 100 and image formation control method will be described. First, the configuration of the density detecting unit 10 will be described, and then the image formation control method will be described.

Figure 2:
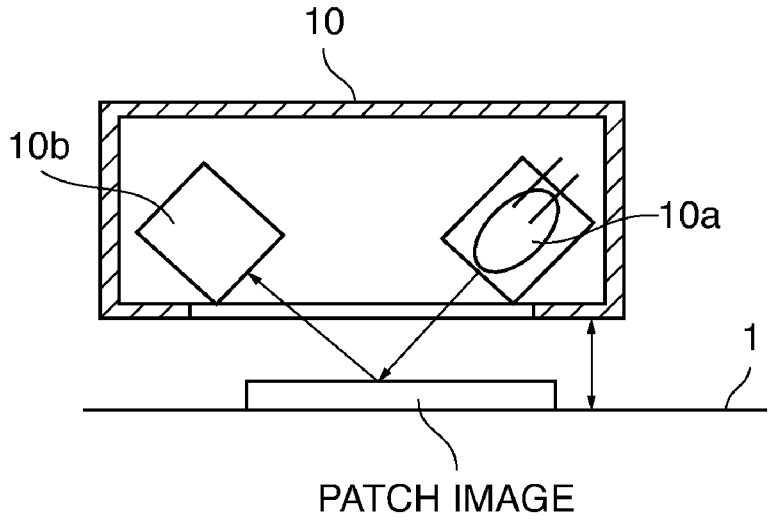
FIG. 2 is a diagram showing the schematic configuration of a density detecting unit in the image forming apparatus of FIG. 1.

FIG. 2 is a diagram showing the schematic configuration of a density detecting unit in the image forming apparatus 100 of FIG. 1.

In FIG. 2, the density detecting unit 10 in the image forming apparatus 100 comprises a light-emitting unit 10*a* comprised of a light emitting diode (LED), and a light-receiving unit 10*b* comprised of a photodiode (PD). The density detecting unit 10 is placed on a portion 5 mm away from the surface of the photoconductive drum 1, for example, and has a constitution in which near-infrared light of 780 nm in wavelength is emitted from the light-emitting unit 10*a*, and the reflected light of the patch image comprising the toner image formed at the predetermined position on the photoconductive drum 1 is entered into the light-receiving unit 10*b*. The density detecting unit 10 can detect the density (layer thickness) of the toner image on the photoconductive drum 1 depending on the intensity of the above reflected light entered into the light-receiving unit 10*b*.

Figure 3:
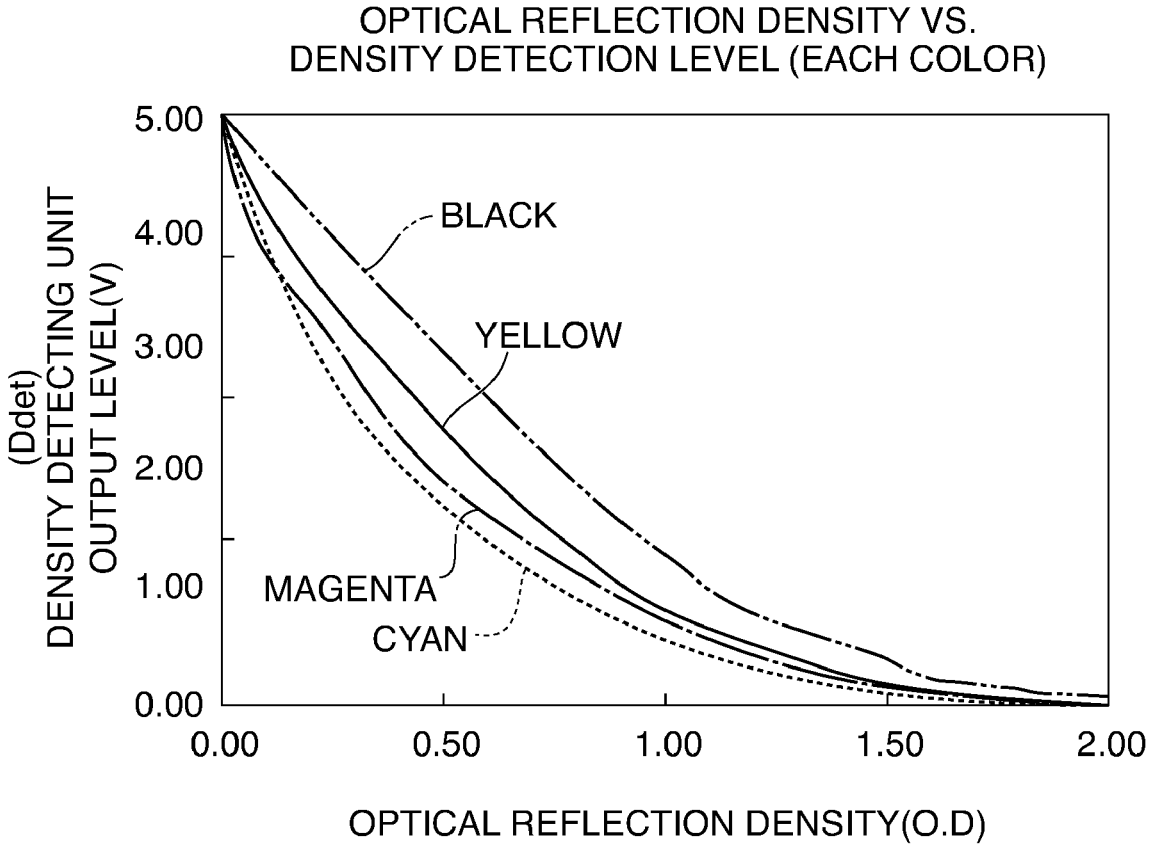
FIG. 3 is a diagram showing the relationship between optical reflection density for each color of an image formed by the image forming apparatus and the output level of the density detecting unit of FIG. 2.

FIG. 3 is a diagram showing the relationship between optical reflection density for each color of an image formed by the image forming apparatus 100 and the output level of the density detecting unit 10 of FIG. 2.

In FIG. 3, a double-dashed line, a solid line, a dashed line, a dotted line indicate the relationship between optical reflection density (toner density (weight) on the photoconductive drum 1) for each color (cyan, magenta, yellow and black) and the output level of the density detecting unit 10 (intensity (voltage) of incident light in the light-receiving unit 10*b*).

Figure 4:
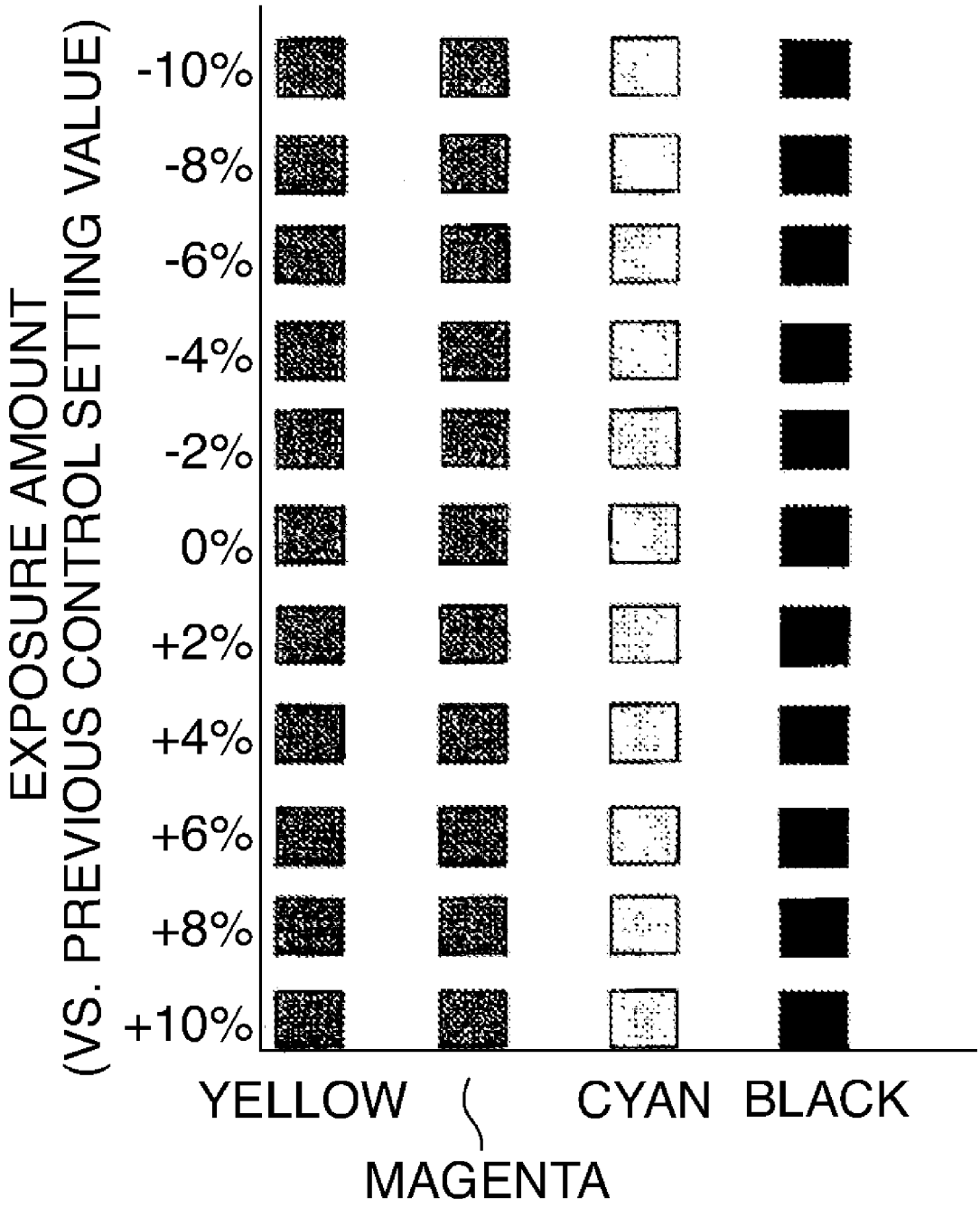
FIG. 4 is a diagram showing the amount of exposure (vs. previous control setting value) of an exposure unit in FIG. 1 for each color of the image formed by the image forming apparatus.

FIG. 4 is a diagram showing the amount of exposure (vs. previous control setting value) of the exposure unit 3 for each color (cyan, magenta, yellow and black) of the image formed by the image forming apparatus 100. Note that it is assumed that the previous exposure amount (previous control setting value) is 0%.

Figure 5:
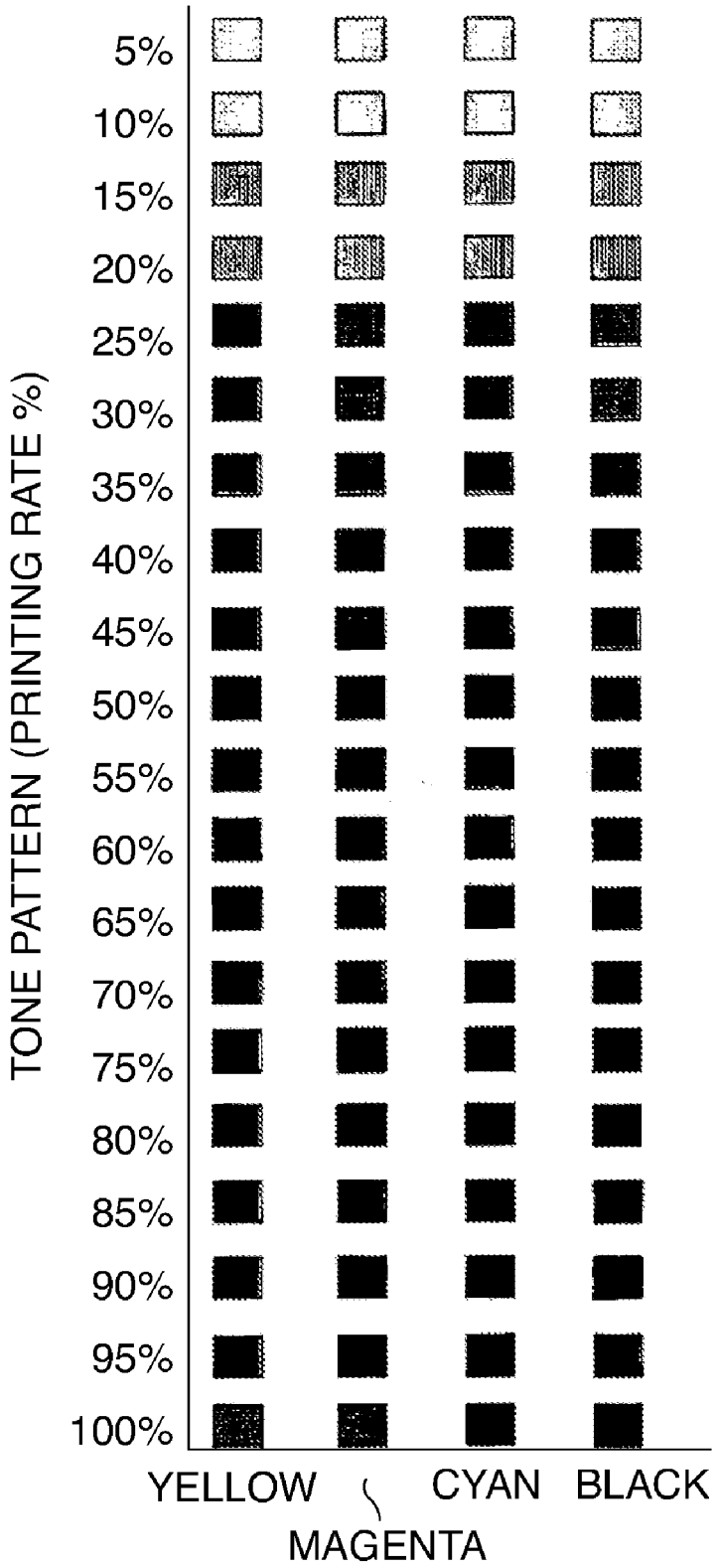
FIG. 5 is a diagram showing a tone pattern (printing rate %) for each color of the image formed by the image forming apparatus.

FIG. 5 is a diagram showing the tone pattern (printing rate 5% to 100%) for each color (cyan, magenta, yellow and black) of the image formed by the image forming apparatus 100.

First, the controller unit 130 forms on the photoconductive drum 1 the patch image of the image data (maximum input image data (8-bit data: 255) in the present embodiment) in which the exposure amount of the exposure unit 3 is sequentially changed as shown in FIG. 4. In addition, the controller unit 130 controls the exposure amount of the exposure unit 3 so that each color (cyan, magenta, yellow and black) has desired density. Hereinafter, this control is referred to as maximum density control.

Next, the controller unit 130 forms on the photoconductive drum 1 each color's patch image resulting from the input image data as shown in FIG. 5 subjected to predetermined process (multi-valued dither process in the present embodiment) from a printing rate of 5% to 100% in increments of 5%. In addition, the controller unit 130 uses the density detecting unit 10 to detect the density of each color's patch image, and generates the LUT of each color so as to obtain the desired tone reproduction based on the detected result. Hereinafter, this control is referred to as tone control. Because the above maximum density control and tone control take time to execute, from the viewpoint of productivity, it is desirable that these controls are executed at time points such as those indicated in the following. Each of the above control is executed when the power source of the image forming apparatus 100 is turned on (during previous rotation by initialization operation), after predetermined time has elapsed after the power source was turned on, after the predetermined number of images have been formed, and when an environment sensor (not shown) detects that the environment has changed by predetermined width or more.

Figure 6:
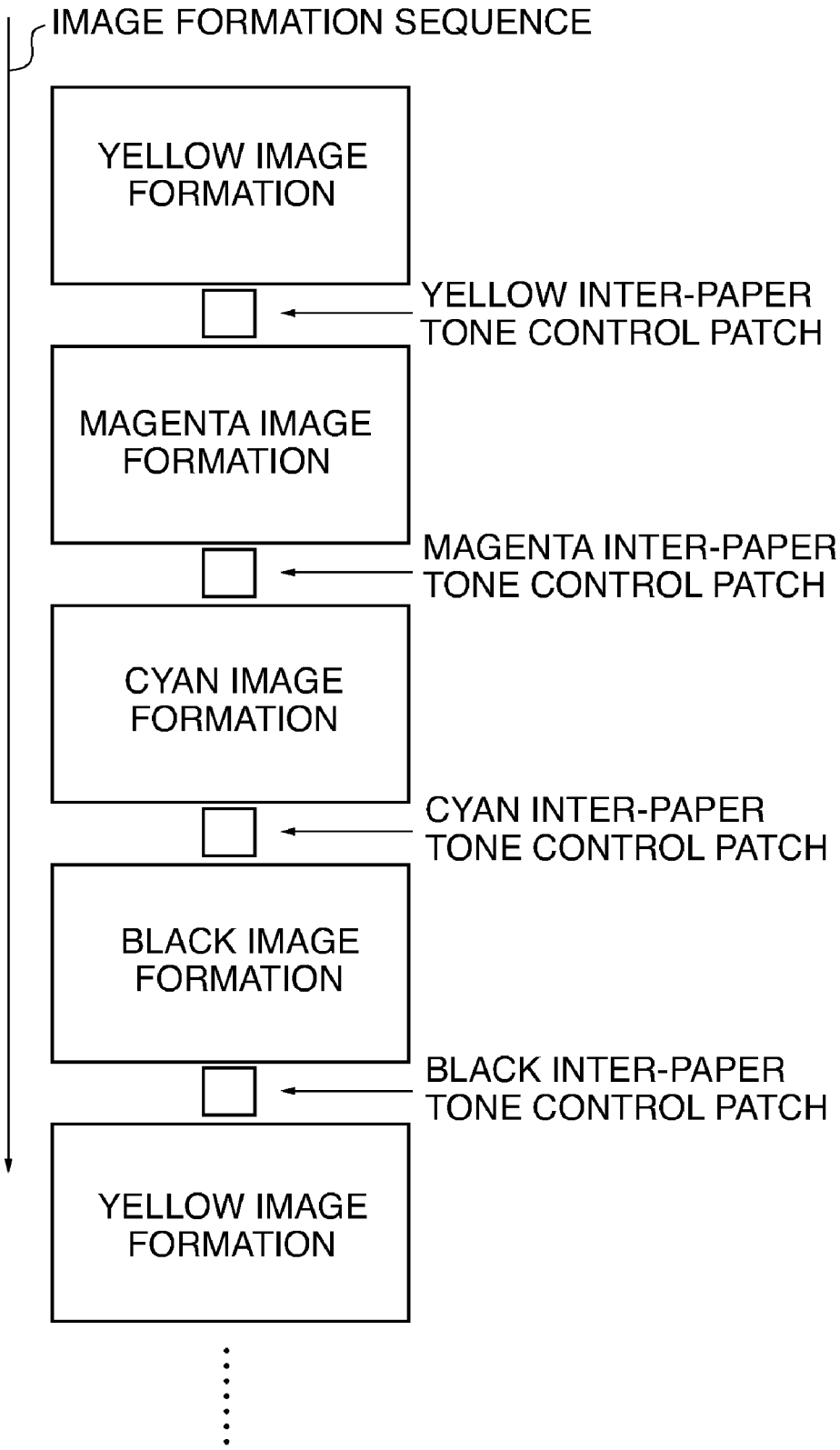
FIG. 6 is a diagram showing a state in which an inter-paper tone control patch image is formed by an inter-paper tone control patch for the formed image every time an image in each color is formed by the photoconductive drum of FIG. 1.

However, it is difficult to suppress fluctuations in the density/color of the image during image formation between these controls by only an approach of executing the above maximum density control and tone control. Accordingly, as shown in FIG. 6 described later, a predetermined (one tone in the present embodiment) inter-paper tone control patch image is formed between the images (inter-paper space between images) when the image in each color (cyan, magenta, yellow and black) is formed on the photoconductive drum 1. The controller unit 130 uses the density detecting unit 10 to detect the density of the inter-paper tone control patch image, and changes the LUT of each color according to the difference between the detected density and the target density. Hereinafter, this control is referred to as inter-paper tone control (image density adjustment control).

FIG. 6 is a diagram showing a state in which the inter-paper tone control patch image is formed by the inter-paper tone control patch for the formed image (yellow, magenta, cyan and black) every time an image in each color (yellow, magenta, cyan and black) is formed by the photoconductive drum 1 of FIG. 1.

Next, operation in the image forming apparatus 100 of the present embodiment having the above configuration will be described in detail with reference to FIGS. 7 to 12. The processes shown in the flowchart of FIGS. 7, 9, 11 and 12 is executed by the CPU 131 of the controller unit 130 based on a program stored in the ROM 132.

Figure 7:
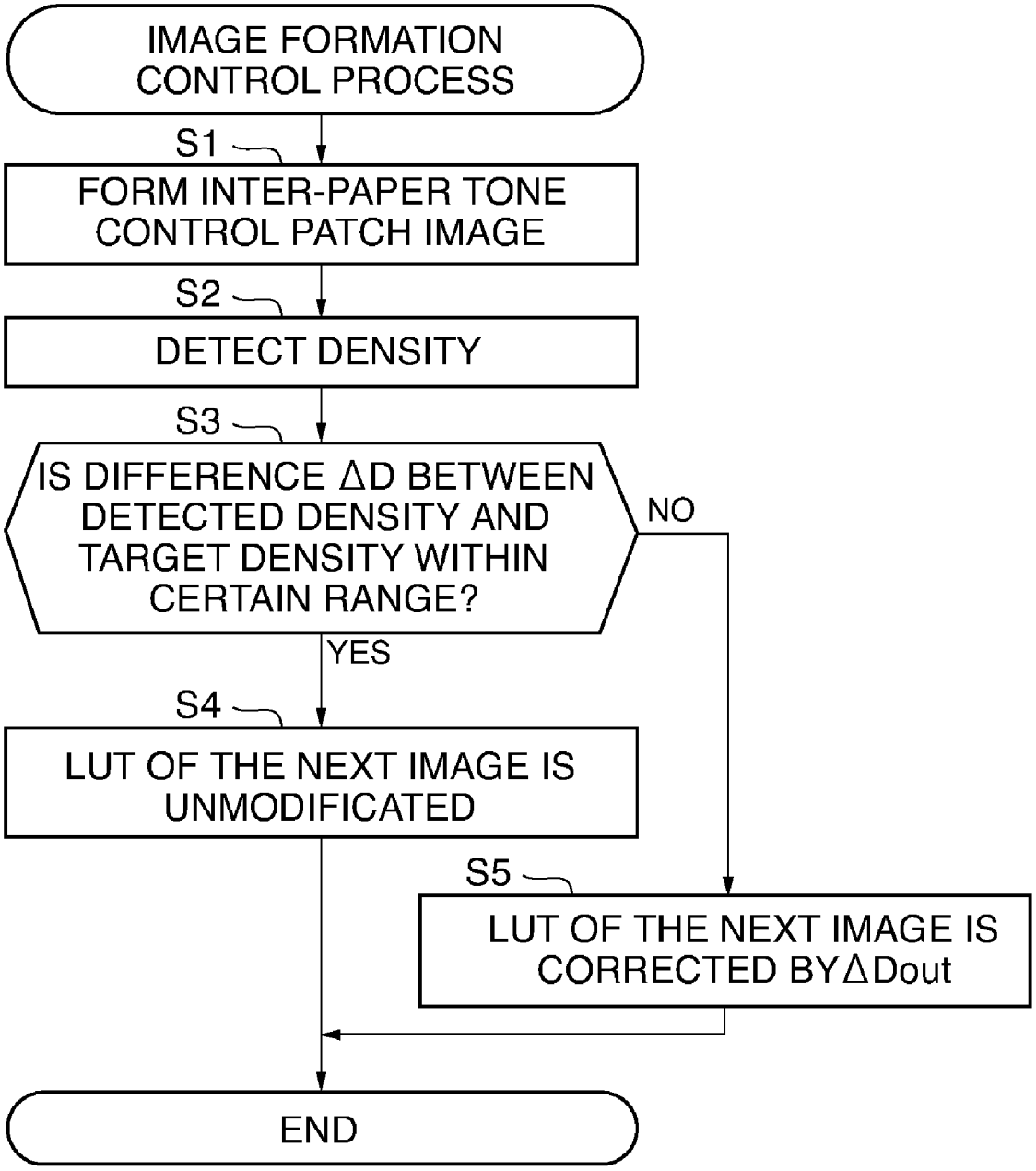
FIG. 7 is a flowchart showing the procedure of image formation control process based on the difference between the detected density and target density of the inter-paper tone control patch image formed in FIG. 6.

FIG. 7 is a flowchart showing the procedure of image formation control process based on the difference between the detected density and target density of the inter-paper tone control patch image formed in FIG. 6.

In FIG. 7, the controller unit 130 forms on the photoconductive drum 1 an inter-paper tone control patch image, which target density is 0.5 for each color (cyan, magenta, yellow and black), between the images in each color (inter-paper: inter-images) (step S11. Next, the controller unit 130 uses the density detecting unit 10 to detect the density of the inter-paper tone control patch image (step S2).

Next, the controller unit 130 determines whether the difference ΔD (=Din−Ddet) between the detected density and target density of the inter-paper tone control patch image is within a predetermined range (step S3). Here, Din is a signal for indicating the target density (hereinafter referred to as "input density signal", and, in the present embodiment, signal strength thereof is 0.5 for each color), and Ddet is a detection signal indicating the detected density of the inter-paper tone control patch image. When the difference ΔD is within the predetermined range, the controller unit 130 uses the LUT of an image to be formed next time without modification (step S4), and terminates this processing. On the other hand, when the difference ΔD is outside the predetermined range (when there is 5% or greater fluctuation in the present embodiment), the controller unit 130 corrects the LUT of an image to be formed next time by a correction value ΔDout (step S5), and terminates this processing.

That is to say, the controller unit 130 calculates the value of the correction value ΔDout with respect to the output density signal Dout from the following equation (1) according to the value of the difference ΔD=Din−Ddet, and corrects the LUT so that an equation (2) is established.

$$\Delta D\text{out}=INT(A*\Delta D/D\text{in}*LUT(D\text{in})) \quad (1)$$

$$LUT'(D\text{in})=LUT(D\text{in})+\Delta D\text{out} \quad (2)$$

where LUT is a state before correction and LUT' is a state after correction. INT( ) is a function indicating a maximum integer not exceeding the numeric value in ( ), and A is a coefficient (A=0.8 in the present embodiment).

Figure 8:
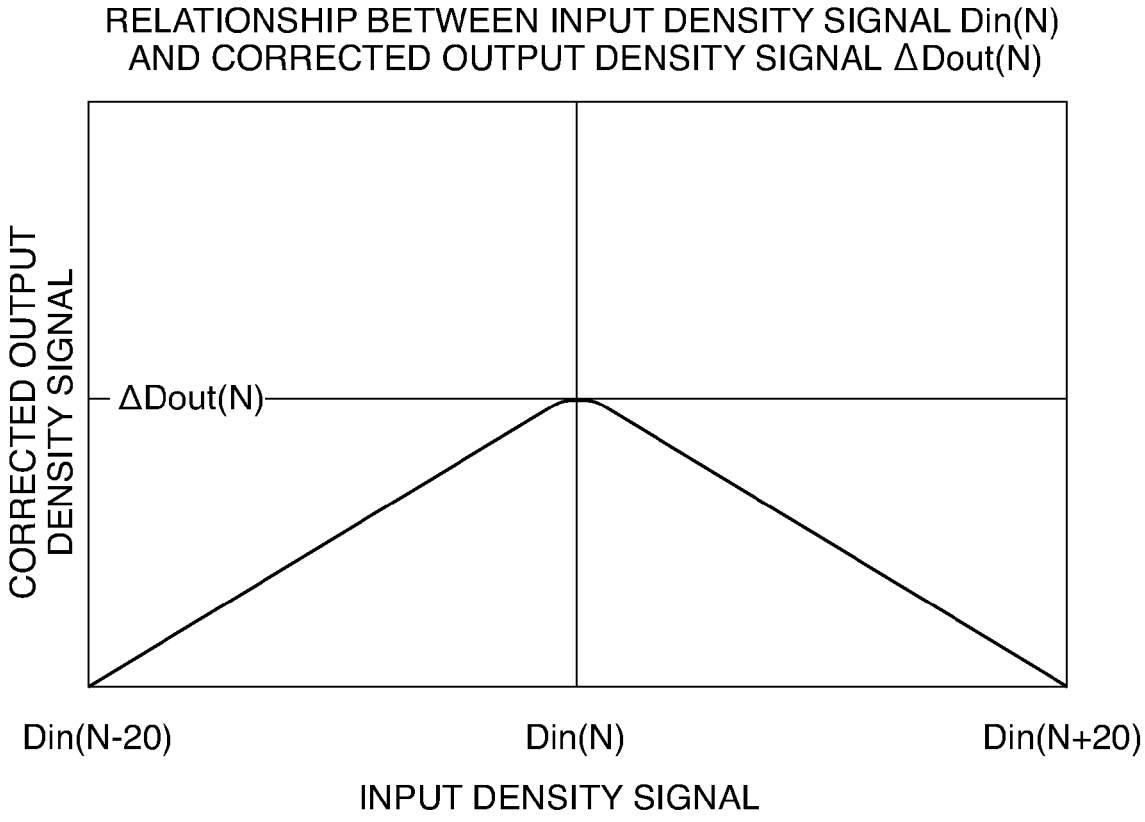
FIG. 8 is a graph showing the relationship between an input density signal and a compensation after correcting a output density signal.

FIG. 8 is a graph showing the relationship between the input density signal Din(N−20) to Din(N+20) and a compensation after correcting the output density signal Dout(N). The output density signal Dout(N) is corrected during the input density signal Din(N−20) to Din(N+20).

In the present embodiment, the frequency is set so that the inter-paper tone control by the controller unit 130 is executed with a ratio of once every images for 20 sheets for each color (cyan, magenta, yellow and black) finished forming in a normal state. In addition, the controller unit 130 uses the printing rate determination unit 134 to determine (calculate) the printing rate of each color for the image of one page, and, when forming an image in which the printing rate of each color is outside 30% to 40% even for one color, changes the frequency of execution of the inter-paper tone control before and after the image formation.

The range of the printing rate used for the change of the frequency of execution of the inter-paper tone control is a device-specific value, and determined based on experiment and experience. In addition, the reason for executing the inter-paper tone control before the image formation is to adjust an image formation condition so as to obtain the target density and stabilize the image to optimize the quality of a print product sought by a client.

Further, the reason for executing the inter-paper tone control by the number of times as required after image formation is to obtain the quality of a print product sought by a client; there is the following reason: for example, so that the amount of supply of a developer, which has been consumed in large quantities during image formation, or the image formation conditions, which changed during image formation, gradually converse so as to obtain the target density.

Figure 9A:
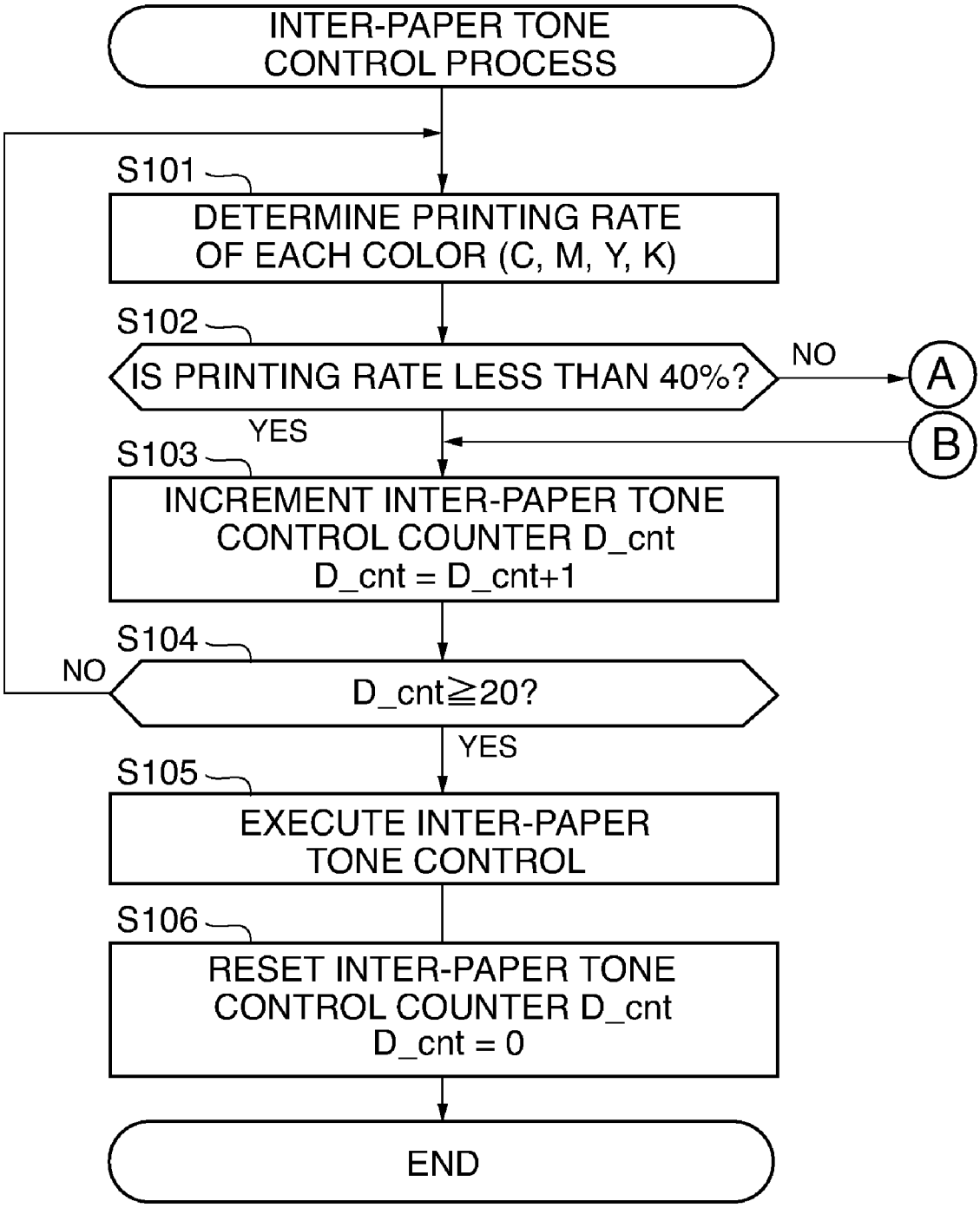
FIGS. 9A and 9B are flowcharts showing the procedure of inter-paper tone control process according to the printing rate determined in the image forming apparatus.
Figure 9B:
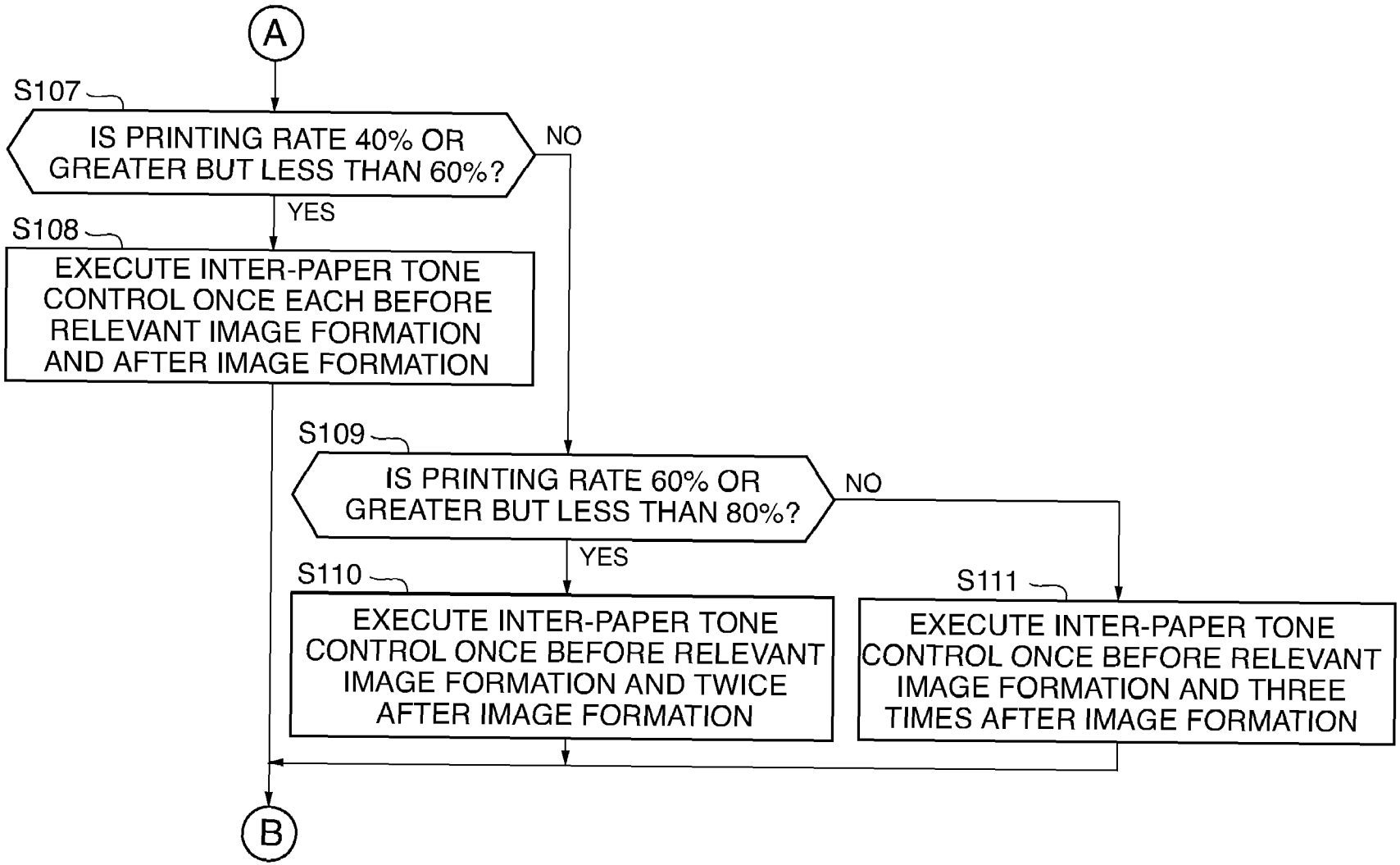

As descried above, when the image density significantly changed and adjustment was performed, the control required time until feedback was effected; this can be eliminated by executing the inter-paper tone control. Note that when the image formation is performed successively, the frequency of execution of the inter-paper tone control may be determined based on the history of the printing rate of each page. FIGS. 9A and 9B are flowcharts showing the procedure of inter-paper tone control process according to the printing rate determined in the image forming apparatus 100.

Figure 10A:
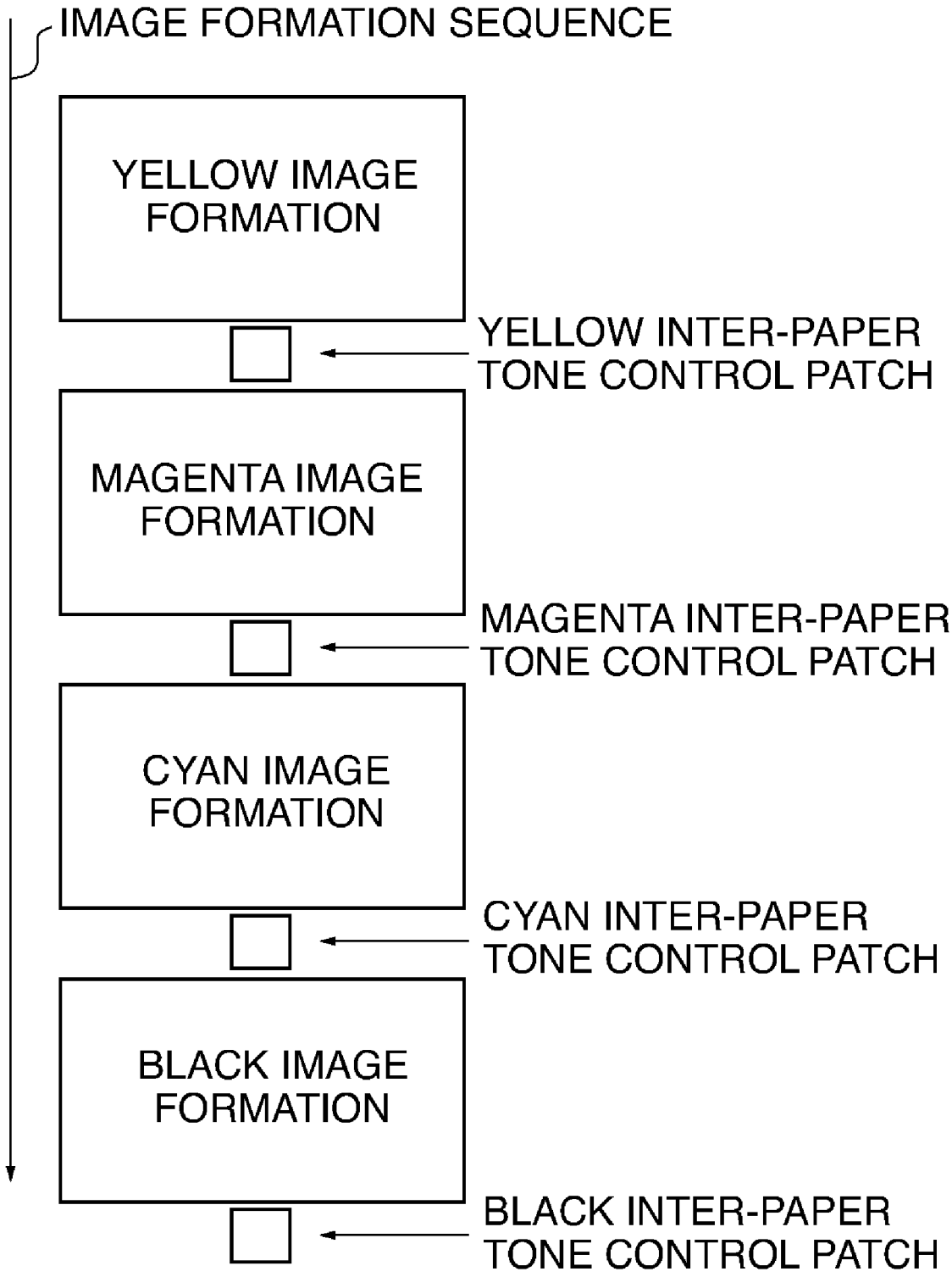
FIGS. 10A to 10C are diagrams used for illustrating the inter-paper tone control process of FIGS. 9A and 9B, FIG. 10B showing processing while a printing rate is being determined to be in a setting range, FIG. 10A showing processing immediately before the processing of FIG. 10B, and while the printing rate is being determined to be outside the setting range, and FIG. 10C showing processing immediately after the processing of FIG. 10B, and while the printing rate is being determined to be outside the setting range.
Figure 10B:
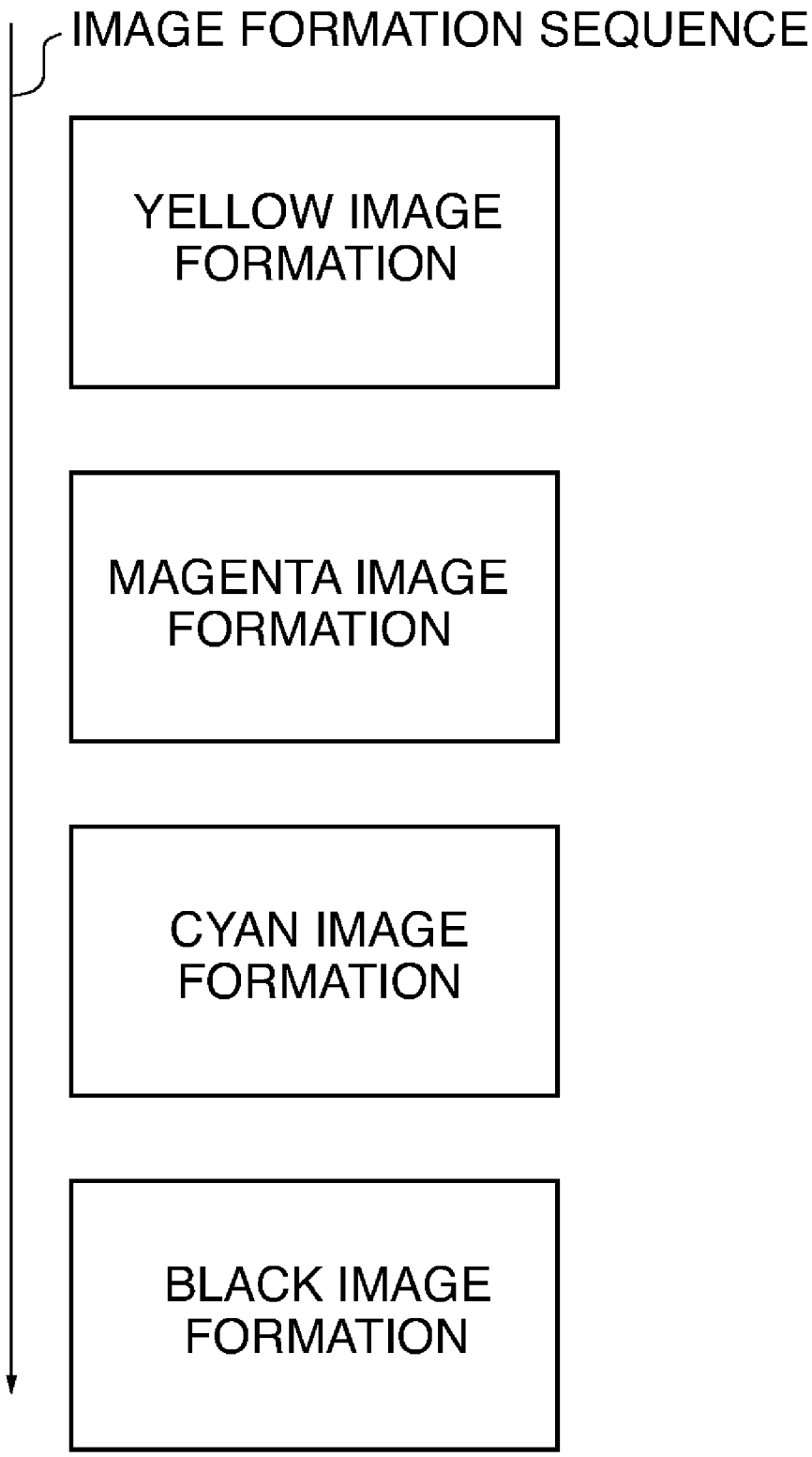
Figure 10C:
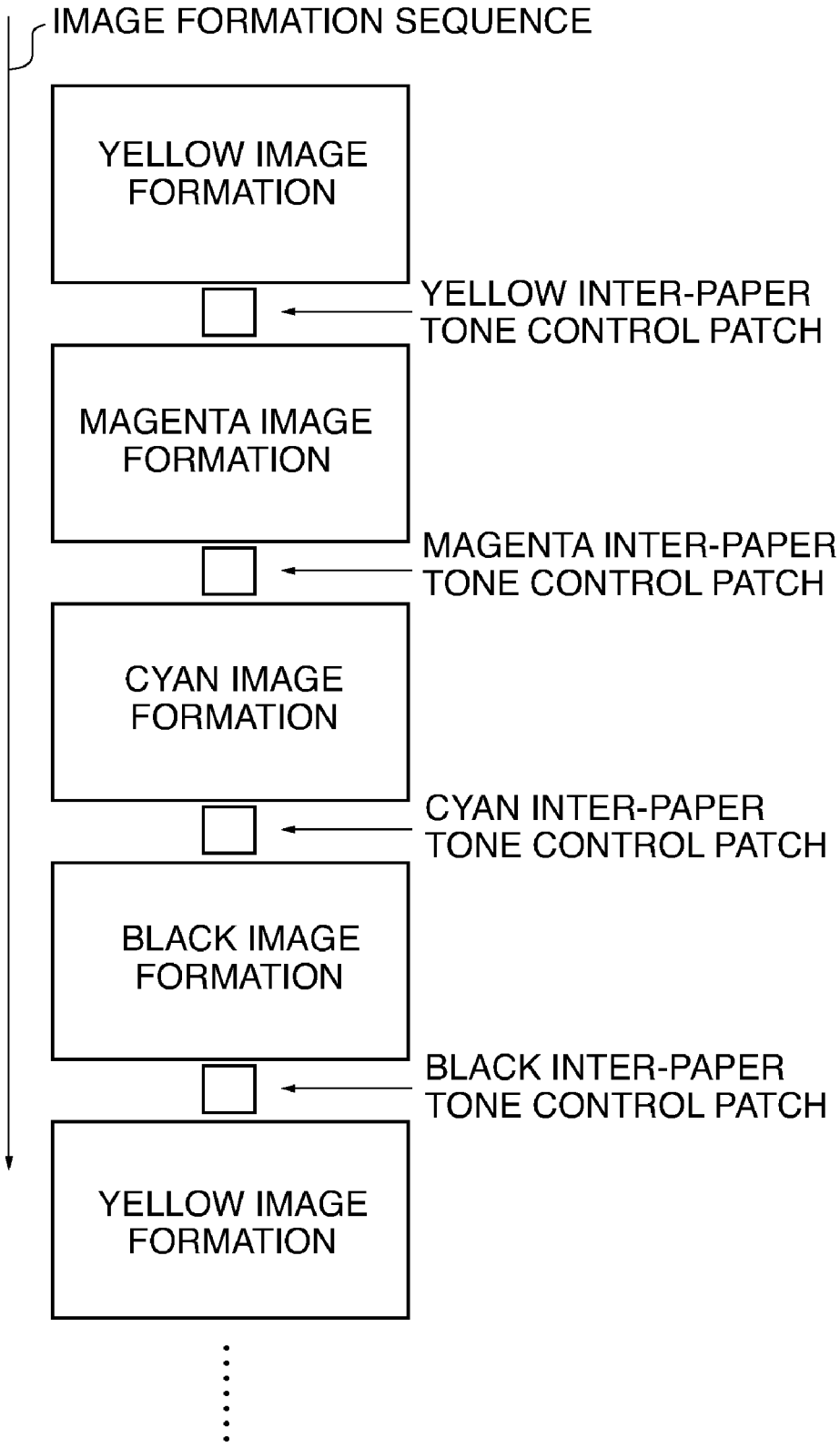

FIGS. 10A to 10C are diagrams used for illustrating the inter-paper tone control processing of FIGS. 9A and 9B, FIG. 10B showing processing while a printing rate is being determined to be in a setting range, FIG. 10A showing processing immediately before the processing of FIG. 10B, and while the printing rate is being determined to be outside the setting range, and FIG. 10C showing processing immediately after the processing of FIG. 10B, and while the printing rate is being determined to be outside the setting range.

In FIGS. 9A and 9B, the controller unit 130 uses the printing rate determination unit 134 to determine (calculate) the printing rate of each image color component for one page (step S101). When all the printing rates of the determined color components are less than 40% (Yes in step S102), the flow proceeds to the processing from step S103 onward. When at least one of the printing rates of the determined color components is 40% or greater but less than 60% (No in step S102, and Yes in step S107), the processing of step S108 is performed, then the processing from step S103 onward is performed. When the maximum value of the printing rates is determined to be 60% or greater but less than 80% (No in step S107, and Yes in step S109), the processing of step S110 is performed, then the processing from step S103 onward is performed. When there is a color component whose printing rate is determined to be 80% or greater (No in step S109), the processing of step S111 is performed, then the processing from step S103 onward is performed.

In the processing of step S103, the controller unit 130 increments an inter-paper tone control counter D_cnt by one for counting the number of sheets of image formation. Then the controller unit 130 determines whether or not the value of the D_cnt reached 20 or greater due to the increment (step S104). When the value of D_cnt is less than 20, the processing is returned to step S101. When the value of D_cnt reaches 20, the controller unit 130 executes the inter-paper tone control (step S105), resets D_cnt (step S106), and terminates this processing.

In addition, in step S108, the controller unit 130 executes the inter-paper tone control once each before the relevant image formation and after the image formation as shown in FIGS. 10A to 10C. In addition, in step S110, the controller unit 130 executes the inter-paper tone control once before the relevant image formation and twice after the image formation.

In addition, in step S111, the controller unit 130 executes the inter-paper tone control once before the relevant image formation and three times after the image formation.

In addition, when image formation is performed successively over multiple pages, it is preferred that the printing rate of a determined color component is kept as history, and the number of times the inter-paper tone control is executed is controlled based on the history. This can prevent the number of times the inter-paper tone control is executed from becoming excessive.

More specifically, based on the above history, when pages in which the printing rate does not satisfy the condition of step S102 occur successively, it is preferred that the number of times of the inter-paper tone control executed between the image formation of each of the successive pages is the integrated value of times of the inter-paper tone controls determined for each page.

For example, a case is considered, where image formation is performed for two successive pages, and the printing rate of each color component (C, M, Y, Bk) for the image of the first page is 10%, 10%, 10% and 90% respectively, and the printing rate of each color component (C, M, Y, Bk) for the image of the second page is 10%, 10%, 10% and 50% respectively.

In this case, step S111 is performed on the first page, that is to say, the inter-paper tone control is executed once before the image formation, and the inter-paper tone control is executed three times after the image formation. On the other hand, the processing of step S108 is performed on the second page, that is to say, the inter-paper tone control is executed once each before and after the image formation. That is to say, if the number of times of the inter-paper tone control executed is not controlled based on the above history, the inter-paper tone control is executed four times in total before image formation of the second page, i.e., the inter-paper tone control is executed three times after image formation of the first page, then the inter-paper tone control is executed once before image formation of the second page.

However, when the number of times of the inter-paper tone control executed is controlled based on the above history, the number of inter-paper tone control before image formation of the second page is executed in total three times (=one time× three times), thus preventing the number of times of the inter-paper tone control executed from being excessive.

Under the above printing rate condition, when the printing rate of each color fluctuates from 0% to 100% on a specific page depending on clients using the image forming apparatus 100, the following happens. Assuming that the levels of color fluctuation at each page subjected to image formation are, as color coordinates between two points, which are indices representing the difference of color with respect to the target, coordinates (L1, a1, b1) for chromaticity 1 and coordinates (L2, a2, b2) for chromaticity 2, the following equation (3) is established.

$$\Delta E=((L1-L2)^2+(a1-a2)^2+(b1-b2)^2)^{1/2} \quad (3)$$

This allows the average ΔE of a plurality of chromaticities, which corresponds to the distance of between the above two points on the color coordinate to fall within a certain range (ΔE<3), thus allowing a good image to be provided as a print product of the variable data print in response to the individual demands of clients.

Note that when the frequency of the inter-paper tone control was set to be uniformly identical regardless of the printing rate and without adopting the control of the above mentioned present embodiment, the level of color fluctuation for each page where image formation was performed was, with respect to the target, ΔE=4.5 on average, and a high-quality print product could not be obtained.

As described above, according to the present embodiment, the following advantage can be attained. An image having the adequate image quality, density and color can be realized according to the purpose of a print product, without provoking excessive consumption of a developer and reduction in productivity, even in an image forming apparatus 100 having large fluctuations in a printing rate such as a convenience printer (POD machine), in particular.

Second Embodiment

The second embodiment of the present invention is different from the above first embodiment in that inter-paper tone control shown in FIG. 11 described later is executed. Therefore, identical sections are designated by the same reference numerals shown in FIGS. 1 and 2, while omitting description thereof.

In the above first embodiment, in order to respond wide range of print products, the configuration is such that the frequency of the inter-paper tone control varies uniformly and similarly according to the printing rate. However, for example, when flyers or the like are printed, which do not really require a high-quality image, the frequency of the inter-paper tone control becomes excessive, resulting in an increase of print cost per sheet due to excessive consumption of developers for inter-paper tone control. On the other hand, for example, when luxury catalogs or the like are printed, which require higher quality image, further stabilization of density/color fluctuation is desired.

As compared thereto, in the present embodiment, from the operation unit (not shown) of an image forming apparatus 100', a user can select image quality (normal image quality (hereinafter, referred to as normal quality), cost priority image quality (hereinafter, cost priority quality), and high-end image quality (hereinafter, high-end quality)). This allows the frequency of the inter-paper tone control in an image forming job to be changed according to the image quality selected from the operation unit, as shown in FIG. 11 described later.

Figure 11:
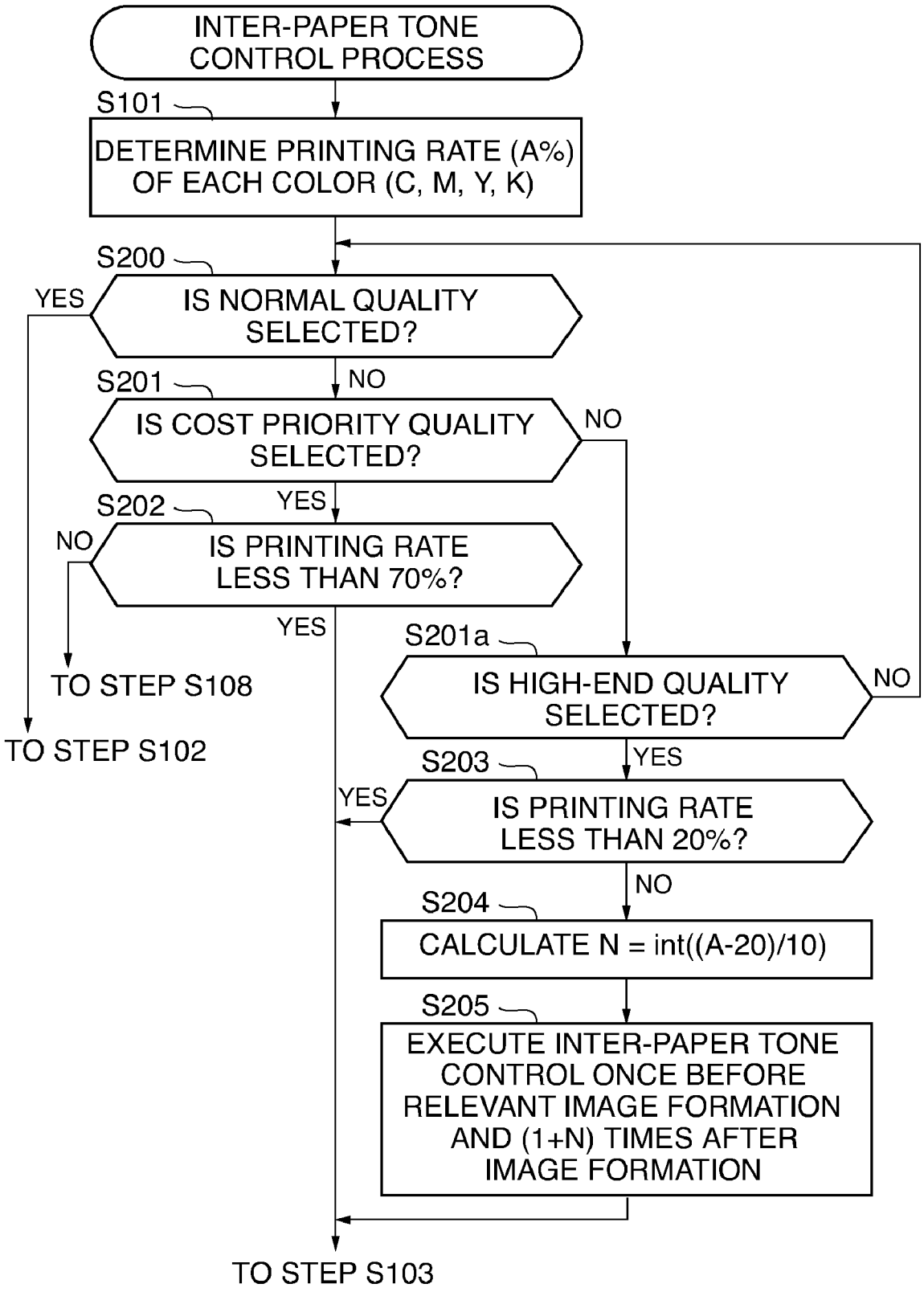
FIG. 11 is a flowchart showing the procedure of the inter-paper tone control process depending on selected image quality, executed by the image forming apparatus according to a second embodiment of the present invention.

FIG. 11 is a flowchart showing the procedure of the inter-paper tone control process depending on selected image quality, executed by the image forming apparatus 100' according to a second embodiment of the present invention.

In FIG. 11, the controller unit 130 uses the printing rate determination unit 134 to determine (calculate) the printing rate A % of each image color component for one page (step S101). Next, the controller unit 130 sorts the processing according to the image quality a user selected with the operation unit. When the normal quality is selected (Yes in step S200), the flow proceeds to the processing from step S102 onward in FIG. 9A. On the other hand, when the cost priority quality is selected (No in step S200, Yes in step S201), and all the printing rates of the color components determined in step S101 are less than 70% (Yes in step S202), the flow proceeds to the processing from step S103 onward in FIG. 9A.

When at least one of the printing rates of the determined color components is 70% or greater (No in step S202), the flow proceeds to the processing from step S108 onward in FIG. 9B. When the high-end quality is selected (Yes in step S201*a*), and all the printing rates of the determined color components are less than 20% (Yes in step S203), the flow proceeds to the processing from step S103 onward in FIG. 9A, on the other hand, when at least one of the printing rates of the determined color components is 20% or greater (No in step S203), the controller unit 130 calculates the number of times of the inter-paper tone control N=int ((A−20)/10) (step S204), and executes the inter-paper tone control once before the relevant image formation, and (1+N) times after the image formation (step S205). Then the flow proceeds to the processing from step S103 onward in FIG. 9A.

That is to say, when the normal quality is selected (Yes in step S200), the same processing as that of the above first embodiment (processing from step S102 onward) is performed. When the cost priority quality is selected (Yes in step S201), only when at least one of the printing rates of the color components determined in step S101 is 70% or greater (No in step S202), the inter-paper tone control is executed once each before the relevant image formation and after the image formation (step S108).

When the high-end quality is selected (Yes in step S201*a*), and at least one of the printing rates of the determined color components is outside 0 to 20% (printing rate is 20% or greater but less than 30%) (No in step S203), the inter-paper tone control is executed once before the relevant image formation, and twice after the image formation (step S205). Subsequently, the frequency of the inter-paper tone control after image formation is increased in increments of 10% of the printing rate.

As described above, according to the present embodiment, the cost priority quality can reduce the excessive consumption of developers. In addition, with the high-end quality, the average of a plurality of chromaticities can be kept at $\Delta E<1.5$, and the maximum of the plurality of chromaticities can be kept at $\Delta E<2.5$, thus allowing sufficient image quality to be provided as high-end quality print products.

Third Embodiment

The third embodiment of the present invention is different from the above first and second embodiments in that inter-paper tone control shown in FIG. 12 described later is executed. Therefore, identical sections are designated by the same reference numerals shown in FIGS. 1 and 2, while omitting description thereof.

In the above second embodiment, the configuration is such that the frequency of the inter-paper tone control varies according to the quality ("normal quality", "cost priority quality" and "high-end quality") of an image selected from the operation unit.

As compared thereto, in the present embodiment, from the operation unit (not shown) of an image forming apparatus 100", a user can select an image formation mode (text/photographic mode, text mode, photographic mode). This allows the frequency of the inter-paper tone control in an image forming job to be changed according to the image formation mode selected from the operation unit, as shown in FIG. 12 described later.

Figure 12:
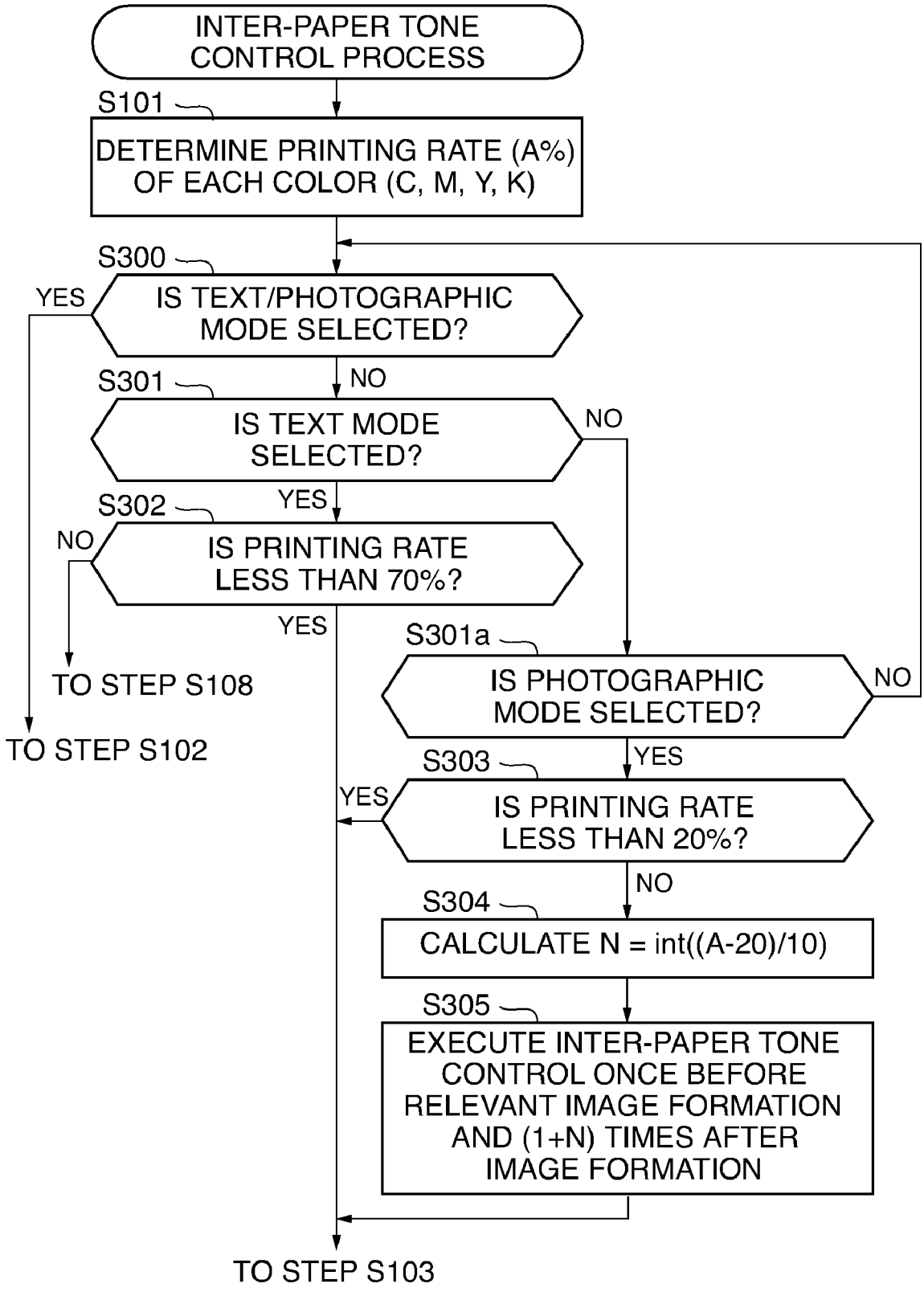
FIG. 12 is a flowchart showing the procedure of the inter-paper tone control process depending on a selected image formation mode, executed by the image forming apparatus according to a third embodiment of the present invention.

FIG. 12 is a flowchart showing the procedure of the inter-paper tone control process depending on a selected image formation mode, executed by the image forming apparatus 1001 according to a third embodiment of the present invention.

In FIG. 12, the controller unit 130 uses the printing rate determination unit 134 to determine (calculate) the printing rate A % of each image color component for one page (step S101). Next, the controller unit 130 sorts the processing according to the image formation mode a user selected with the operation unit. When the text/photographic mode is selected (Yes in step S300), the flow proceeds to the processing from step S102 onward in FIG. 9A. On the other hand, when the text mode is selected (No in step S300, Yes in step S301), and all the printing rates of the color components determined in step S101 are less than 70% (Yes in step S302), the flow proceeds to the processing from step S103 onward in FIG. 9A.

When at least one of the printing rates of the determined color components is 70% or greater (No in step S302), the flow proceeds to the processing from step S108 onward in FIG. 9B. When the text/photographic mode is selected (Yes in step S301*a*), and all the printing rates of the determined color components are less than 20% (Yes in step S303), the flow proceeds to the processing from step S103 onward in FIG. 9A, on the other hand, when at least one of the printing rates of the determined color components is 20% or greater (No in step S303), the controller unit 130 calculates the number of times of the inter-paper tone control N=nt ((A−20)/10) (step S304), and executes the inter-paper tone control once before the relevant image formation, and (1+N) times after the image formation (step S305). Then the flow proceeds to the processing from step S103 onward in FIG. 9A.

That is to say, when the text mode is selected (Yes in step S301), the frequency of controls is similar to that of the cost priority quality. When the text/photographic mode is selected (Yes in step S300), the frequency of controls is similar to that of the normal quality. When the photographic mode is selected (No in step S303), the frequency of controls is similar to that of the high-end quality.

As described above, according to the present embodiment, the inter-paper tone control is executed at optimal control frequency depending on the target print product similarly to the above second embodiment, allowing both a reduction in excessive consumption of developers and the realization of a good image quality according to the purpose to be achieved.

Other Embodiments

Although the above first to third embodiments have been applied to a system comprised of one photoconductive drum and one intermediate transfer belt, the present invention may be applied to a system comprised of an appropriate number of photoconductive members with respect to the number of colors of developers and one intermediate transfer member, and a system comprised of an appropriate number of photoconductive members with respect to the number of colors of developers and a carrier belt for carrying a recording material. In addition, although a patch image has been formed on a photoconductive member, it may be formed on an intermediate transfer member.

In addition, although in the above first to third embodiments, a frequency at which the inter-paper tone control is executed according to a printing rate has been changed, the present invention is not limited thereto. This control is for increasing the convergence of the fluctuation since, in the electrophotographic image forming apparatus, the fluctuation of the amount of electrical charge of a developer tends to increase as the printing rate increases, and if the fluctuation of the amount of electrical charge is large, the level of fluctuation of the density/color is large. Needless to say, the frequency at which the inter-paper tone control is executed may be changed as appropriate according to the configuration of the image forming apparatuses 100, 100', 100" and types of the developers. For example, for a certain type of developers, when the printing rate is 30 to 50%, the inter-paper tone control may be executed at normal frequency, and when the printing rate is outside 30 to 50%, the frequency at which the inter-paper tone control is executed may be changed as appropriate according to the printing rate.

In addition, in the above first to third embodiments, although LUT is generated so as to obtain desired tone reproduction as inter-paper tone control, the present invention is not limited thereto. According to the configuration of the image forming apparatus 100, any one or more of the charge amount, the exposure amount, the developing bias and the supply amount of developers may be used instead of LUT, or used in combination with LUT, as appropriate.

In addition, although, in the above first to third embodiments, only inter-paper tone control has been executed to realize adequate image quality, the present invention is not limited thereto. The tone pattern of each printing rate is formed on the photoconductive drum 1 as shown in FIG. 5, the density of the photoconductive drum 1 or the sheet is detected, processing such as reproduction of LUT is performed, and the density may be adjusted with higher accuracy without reducing productivity.

In addition, although, in the above first to third embodiments, concrete printing rates have been described in the flowcharts of FIGS. 9, 11 and 12, the present invention is not limited thereto. Each of the printing rates can be changed as appropriate without departing from the scope of the present invention.

In addition, in the above first to third embodiments, the relative position, equations, and numeric values of the components of the image forming apparatuses 100, 100', 100", as long as they are not specific, may be changed as appropriate without departing from the scope of the preset invention.

It is to be understood that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of any of the embodiments described above, and hence the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, DVD-ROM, a DVD-RAM, a DVD–RW, a DVD+RW, a magnetic tape, a nonvolatile memory card, and a ROM. Alternatively, the program code may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on the instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2006-257521 filed Sep. 22, 2006, which is hereby incorporated by reference herein in its entirety.

What is claimed is:

1. An image forming apparatus comprising:

an image forming unit adapted to perform image formation by forming a latent image on an image carrier based on image information, then developing and transferring the latent image;

another image forming unit adapted to form an image for adjustment on a portion other than a portion on which the latent image is formed on the image carrier by said image forming unit;

a detecting unit adapted to detect the density of the image for adjustment;

an adjustment unit adapted to adjust image density based on the density of the image for adjustment detected by said detecting unit;

an image formation control executing unit adapted to execute image formation control whereby density is adjusted by said adjustment unit when an image is formed by said image forming unit; and a control unit adapted to calculate a printing rate that indicates the percentage of the image formation to a sheet used for image formation, and, when the printing rate is determined to be within a set range, execute the image formation control at a set frequency, on the other hand, when the printing rate is determined to be outside the set range, change the set frequency and execute the image formation control, wherein said control unit executes the image formation control before and after the image formation of the image information when the printing rate is determined to be outside the set range.

2. An image forming apparatus comprising:

an image forming unit adapted to perform image formation by forming a latent image on an image carrier based on image information, then developing and transferring the latent image;

another image forming unit adapted to form an image for adjustment on a portion other than a portion on which the latent image is formed on the image carrier by said image forming unit;

a detecting unit adapted to detect the density of the image for adjustment;

an adjustment unit adapted to adjust image density based on the density of the image for adjustment detected by said detecting unit;

an image formation control executing unit adapted to execute image formation control whereby density is adjusted by said adjustment unit when an image is formed by said image forming unit; and a control unit adapted to calculate a printing rate that indicates the percentage of the image formation to a sheet used for image formation, and, when the printing rate is determined to be within a set range, execute the image formation control at a set frequency, on the other hand, when the printing rate is determined to be outside the set range, change the set frequency and execute the image formation control, wherein the printing rate is calculated with respect to each image color component for one page comprised of multiple colors, said image forming unit forms the latent image for the each color of the image on the image carrier, said another image forming unit forms the image for adjustment between the latent images for the each color formed on the image carrier, and said control unit calculates the printing rate for the each color of the image, and, when at least one of the printing rates is determined to be outside the set range, executes the image formation control before and after the image formation of the image information.

3. The image forming apparatus according to claim 2, further comprising a keeping step of keeping a history of the printing rate for each page, wherein said control unit determines the frequency of execution of the image formation control based on the history when image formation of a plurality of pages is performed successively.

4. The image forming apparatus according to claim 3, wherein the control unit sets the frequency of execution of image formation control that is executed between the pages determined to be successively outside the set range as an integrated value of the determined frequency when the printing rate at each page of the history is successively outside the set range.

5. An image forming apparatus comprising:

an image forming unit adapted to perform image formation by forming a latent image on an image carrier based on image information, then developing and transferring the latent image;

another image forming unit adapted to form an image for adjustment on a portion other than a portion on which the latent image is formed on the image carrier by said image forming unit;

a detecting unit adapted to detect the density of the image for adjustment;

an adjustment unit adapted to adjust image density based on the density of the image for adjustment detected by said detecting unit;

an image formation control executing unit adapted to execute image formation control whereby density is adjusted by said adjustment unit when an image is formed by said image forming unit;

a control unit adapted to calculate a printing rate that indicates the percentage of the image formation to a sheet used for image formation, and, when the printing rate is determined to be within a set range, execute the image formation control at a set frequency, on the other hand, when the printing rate is determined to be outside the set range, change the set frequency and execute the image formation control; and a state selection unit adapted to select the image formation state of an image product, wherein the control unit changes the frequency of execution of the image formation control according to the image formation state selected by said state selection unit, and wherein the image formation state is selected from a group including normal image quality, cost priority image quality, and high-end image quality.

6. An image forming apparatus comprising:

an image forming unit adapted to perform image formation by forming a latent image on an image carrier based on image information, then developing and transferring the latent image;

another image forming unit adapted to form an image for adjustment on a portion other than a portion on which the latent image is formed on the image carrier by said image forming unit;

a detecting unit adapted to detect the density of the image for adjustment;

an adjustment unit adapted to adjust image density based on the density of the image for adjustment detected by said detecting unit;

an image formation control executing unit adapted to execute image formation control whereby density is adjusted by said adjustment unit when an image is formed by said image forming unit;

a control unit adapted to calculate a printing rate that indicates the percentage of the image formation to a sheet used for image formation, and, when the printing rate is determined to be within a set range, execute the image formation control at a set frequency, on the other hand, when the printing rate is determined to be outside the set range, change the set frequency and execute the image formation control; and an image formation mode selection unit adapted to select an image formation mode of an image product, wherein the control unit changes the frequency of execution of the image formation control according to the image formation mode selected by said image formation mode selection unit.

7. The image forming apparatus according to claim 6, wherein the image formation mode is selected from a group including a text mode, a text/photographic mode, and a photographic mode.

* * * * *